US006622678B2

(12) United States Patent
Shimizu et al.

(10) Patent No.: US 6,622,678 B2
(45) Date of Patent: Sep. 23, 2003

(54) APPARATUS AND METHOD FOR CONTROLLING VARIABLE VALVE MECHANISM

(75) Inventors: Hirokazu Shimizu, Atsugi (JP); Kenichi Machida, Atsugi (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/175,276

(22) Filed: Jun. 20, 2002

(65) Prior Publication Data

US 2002/0195071 A1 Dec. 26, 2002

(30) Foreign Application Priority Data

Jun. 21, 2001 (JP) ..... 2001-188044

(51) Int. Cl.[7] ..... F01L 1/34
(52) U.S. Cl. ..... 123/90.16; 123/90.15
(58) Field of Search ..... 123/90.15, 90.16, 123/90.17

(56) References Cited

U.S. PATENT DOCUMENTS 4,723,514 A * 2/1988 Taniuchi ..... 123/65 V
4,765,288 A * 8/1988 Linder et al. ..... 123/90.16

FOREIGN PATENT DOCUMENTS

JP 2001-12262 1/2001

* cited by examiner

*Primary Examiner*—Thomas Denion
*Assistant Examiner*—Jaime Corrigan
(74) *Attorney, Agent, or Firm*—Foley & Lardner

(57) ABSTRACT

In a variable valve mechanism that changes an opening characteristic of an engine valve by a rotation force of a direct current motor, an electric current to be supplied to the direct current motor is forcibly lowered by providing restriction to a control signal of a power transistor that supplies the electric current to the direct current motor, or providing restriction to a change speed of target value of the opening characteristic, when an engine temperature is high.

18 Claims, 7 Drawing Sheets

APPARATUS AND METHOD FOR CONTROLLING VARIABLE VALVE MECHANISM

FIELD OF THE INVENTION

The present invention relates to an apparatus and a method for controlling a variable valve mechanism, more particularly, to an apparatus and a method for controlling a variable valve mechanism that changes an opening characteristic of an engine valve by a rotation force of a direct current motor.

RELATED ART OF THE INVENTION

Heretofore, there has been known a variable valve mechanism that successively changes a valve lift amount and an operating angle of an engine valve (intake valve or exhaust valve), using a direct current motor (refer to Japanese Unexamined Patent Publication No. 2001-012262).

In the above variable valve mechanism, in a case where the direct current motor and a control unit including a power transistor are integrated with each other, to be mounted on a cylinder head, temperatures of the direct current motor and of the control unit rise with the rise of engine temperature.

Therefore, in order to adopt the above-mentioned integrated construction, it is required to be able to prevent the burn out of motor or control unit even when the engine temperature is high and also a large electric current needs to be supplied.

SUMMARY OF THE INVENTION

The present invention has been achieved in view of the forgoing problem, and has an object to provide an apparatus and a method for controlling a variable valve mechanism, capable of preventing the burn out of motor or control unit.

In order to achieve the above object, according to the present invention, the construction is such that, when an engine temperature exceeds a predetermined temperature, an electric current to be supplied to a direct current motor is forcibly reduced.

The other objects and features of this invention will become understood from the following description with accompanying drawings.

PREFERRED EMBODIMENT

Figure 1:
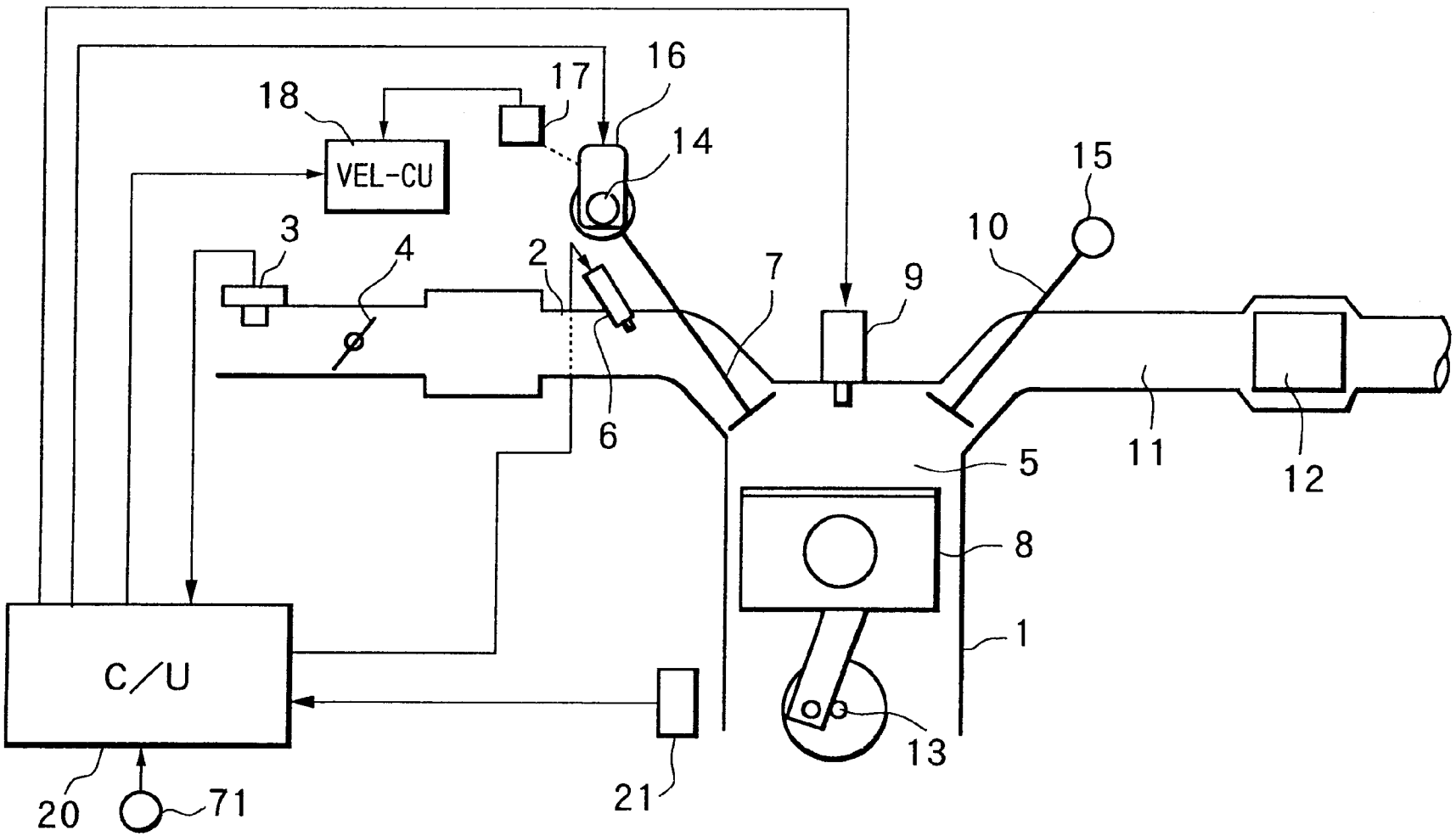
FIG. 1 is a diagram showing a system structure of an engine.

FIG. 1 is a diagram showing a system structure of an engine equipped with a variable valve mechanism.

An air flow meter 3 that detects an intake air amount Q is disposed in an intake passage 2 of an engine 1.

A throttle valve 4 that controls the intake air amount Q is disposed on the downstream side of air flow meter 3.

A fuel injection valve 6 is disposed to an intake port portion on the downstream of intake passage 2.

An air-fuel mixture is formed by fuel injected from fuel injection valve 6, and air drawn through throttle valve 4 and an intake valve 7.

The air-fuel mixture is compressed within a combustion chamber 5 by a piston 8 and then is ignited by spark ignition by an ignition plug 9 disposed inside combustion chamber 5.

An exhaust gas of engine 1 is discharged to an exhaust passage 11 from combustion chamber 5 through an exhaust valve 10, to be discharged into the atmosphere through an exhaust purification catalyst 12 disposed on the downstream of exhaust passage 11.

Intake valve 7 and exhaust valve 10 are driven to open/close by operations of cams that are disposed respectively on an intake side camshaft 14 and an exhaust side camshaft 15, which are driven to rotate by a crankshaft 13.

On the intake side, a variable valve event and lift mechanism 16 (VEL) that successively performs a variable control of a valve lift and a valve event of intake valve 7 is disposed.

VEL mechanism 16 is constructed to successively change the valve lift and the valve event of intake valve 7 in accordance with an angle of a control shaft that is driven to rotate by a direct current motor.

A detailed structure of VEL mechanism 16 including the control shaft and the direct current motor will be described later.

An engine control unit (ECU) 20 is input with an output signal from air flow meter 3 and a crank angle signal output from a crank angle sensor 21 that is disposed on crankshaft 13 to detect a rotation position of crankshaft 13.

Engine control unit 20 computes a fuel injection quantity and a target angle of control shaft (a target value of opening characteristic), respectively, based on detection signals from the respective sensors.

Then, engine control unit 20 outputs the target angle to a VEL control unit (VEL-CU) 18 that controls VEL mechanism 16.

VEL-CU 18 feedback controls an electric current to be supplied to the DC motor based on an angle signal of the control shaft output from an angle sensor 17, so that an actual angle of the control shaft is converged to the target angle.

Figure 2:
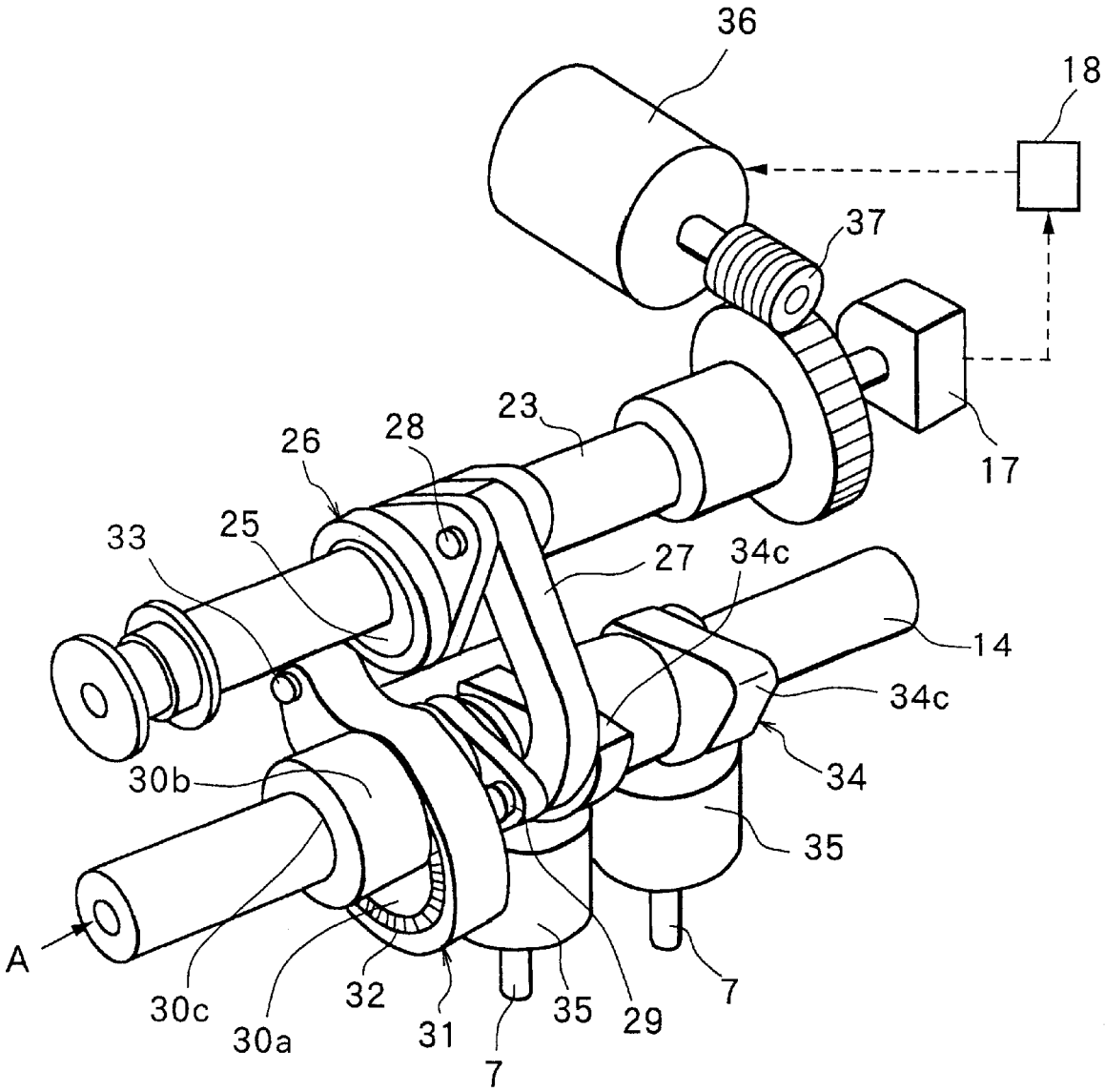
FIG. 2 is a perspective view showing a main part of a variable valve mechanism.
Figure 3:
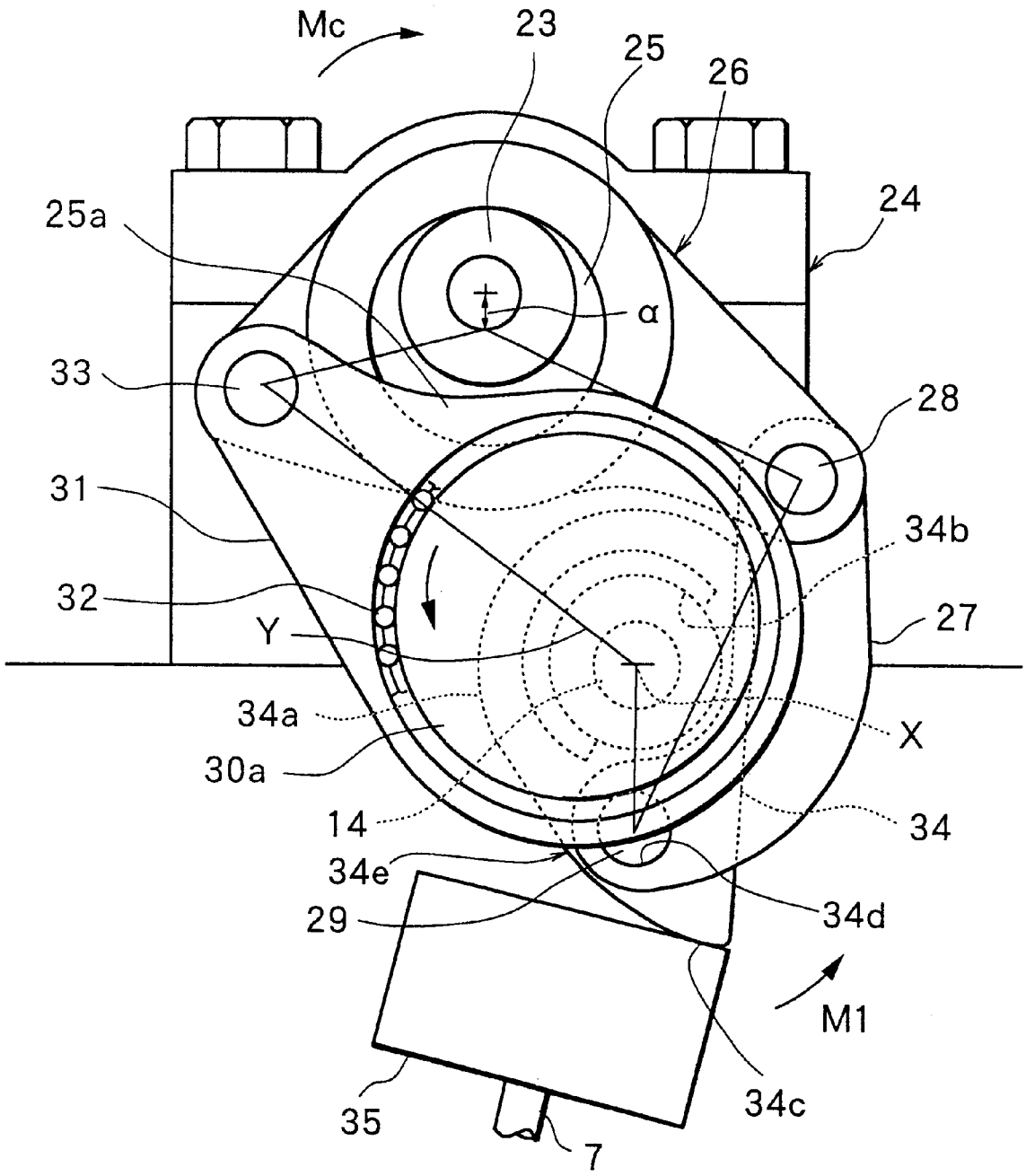
FIG. 3 is an A arrow view of FIG. 2.

Next, VEL mechanism 16 will be described based on FIG. 2 and FIG. 3.

A control shaft 23 of VEL mechanism 16 is arranged in parallel with intake side camshaft 14 and both ends thereof are supported by bearings 24 fixed to cylinder blocks not shown in the figures.

A control cam 25 is formed in a substantially cylindrical shape having an outer diameter greater than control shaft 23, and is disposed on control shaft 23 in a state where the center axis thereof is biased by a predetermined amount $\alpha$ from the center axis of control shaft 23.

A rocker arm 26 is formed in a substantially rhombus shape and an outer surface of control cam 25 is slidably inserted into a through hole formed on the center of rocker arm 26.

A link rod 27 is formed in a substantially crescent shape and one end thereof is rotatably connected with one end of rocker arm 26 via a pin 28 and the other end thereof is rotatably connected to a position biased from the center axis of intake side camshaft 14 via a pin 29.

A driving cam 30 comprises a cam body 30*a* formed in a cylindrical shape having a large outer diameter, and a cylindrical portion 30*b* which is formed in a cylindrical shape having a small outer diameter and is disposed adjacent to one end of cam body 30*a*. A shaft hole 30*c* is formed through the central portion of cylindrical portion 30*b* and intake side camshaft 14 is slidably inserted into shaft hole 30*c*.

The center axis of cylindrical portion 30*b* is coincident with the center axis X of intake side camshaft 14, but the center axis Y of cam body 30*a* is biased by a predetermined amount from the center axis X of intake side camshaft 14.

A link arm 31 is formed in an annular shape having an outer diameter larger than driving cam 30, and a periphery of cam body 30*a* of driving cam 30 is slidably inserted into a hole formed passing through the central portion of link arm 31 via bearings 32.

An end portion of link arm 31 projecting into an outer diameter direction thereof is rotatably connected to the other end of rocker arm 26 via a pin 33.

An intake cam 34 is fixed to intake side cam 14 in such a manner that intake side cam 14 is inserted into a shaft hole 34*b* passing through a base end 34*a*. On the other hand, intake cam 34 is rotatably connected to link rod 27 such that a pin hole 34*d* is formed through a cam nose portion 34*c* positioned on an end portion of intake cam 34 projecting into an outer diameter direction from base end 34*a*, and pin 29 is inserted into pin hole 34*d*.

A valve lifter 35 is formed in a cylindrical shape with a lid and a cam surface 34*e* of intake cam 34 is in contact with a predetermined position of an upper surface of valve lifter 35 in accordance with a swing position of intake cam 34, while intake valve 7 is fixed to a bottom portion of valve lifter 35.

A DC motor 36 has a worm gear 37 which is fixed to a driving shaft end thereof and meshes with a gear fixed to one end of control shaft 23, and rotates control shaft 23 within a fixed range by a driving signal output from VEL-CU 18.

DC motor 36, VEL-CU 18 including power transistor, and angle sensor 17 are integrally mounted on cylinder head of engine 1 directly.

Angle sensor 17 is disposed on one end of control shaft 23, to detect an angle of control shaft 23 to output a detection signal to VEL-CU 18.

Next, an operation principle of VEL 16 will be described.

Figure 4A:
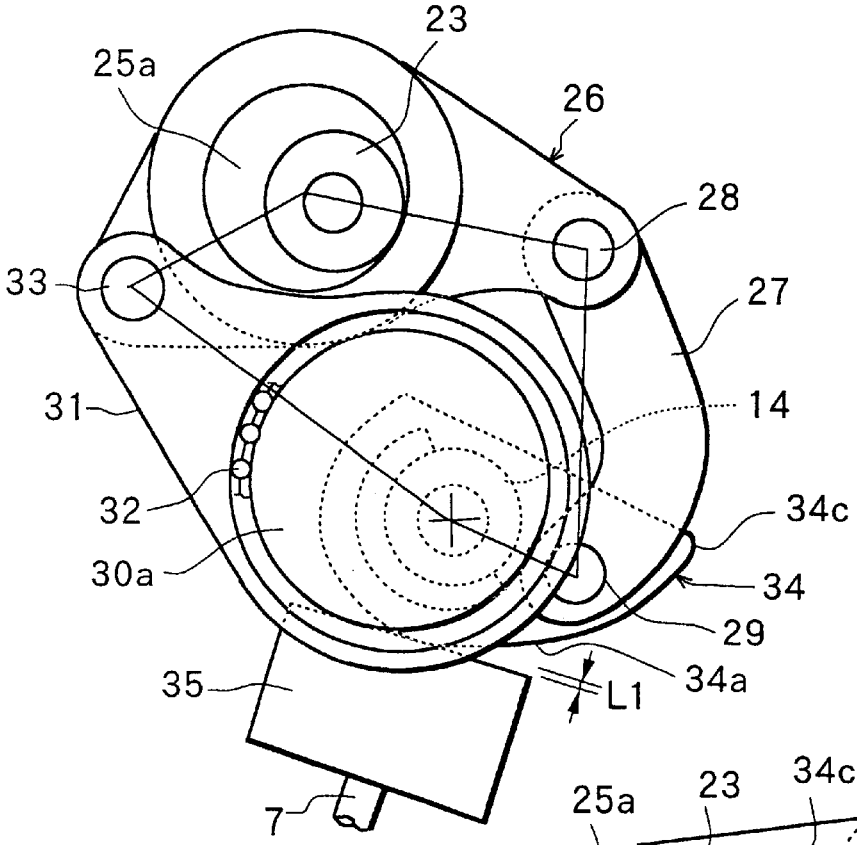
FIG. 4A is a function explanation view of the variable valve mechanism showing a valve opening state at a minimum lift amount.
Figure 4B:
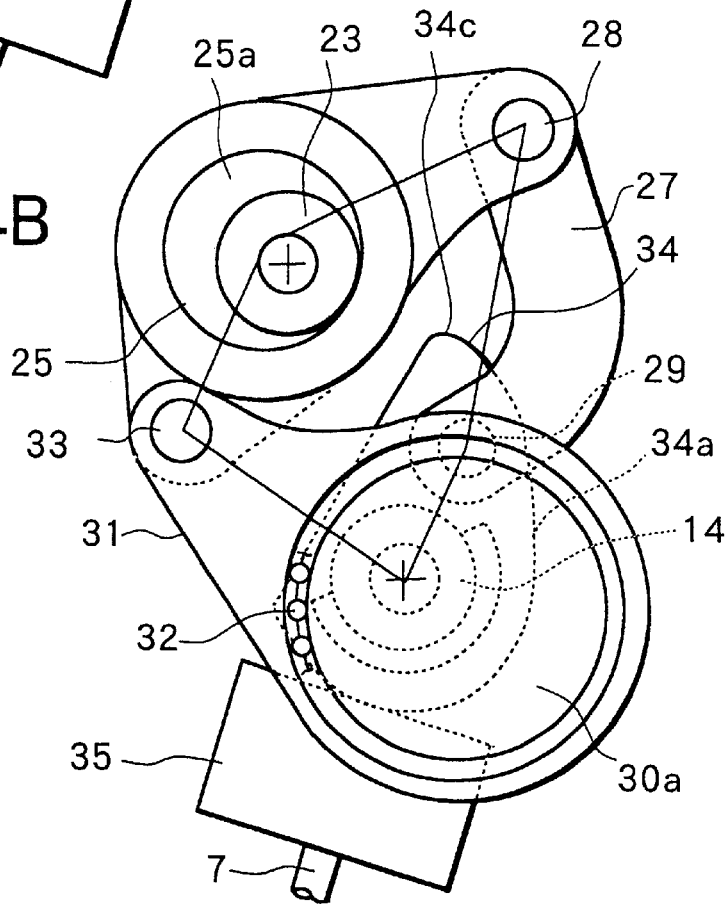
FIG. 4B is a function explanation view of the variable valve mechanism showing a valve closing state at the minimum lift amount.

FIG. 4A and FIG. 4B respectively show a state where a valve lift amount is controlled to a minimum amount.

When DC motor 36 is driven to provide control shaft 23 with a clockwise rotation for controlling the lift amount to the minimum amount, a thick portion 25*a* of control cam 25 moves upward and in synchronization with this rocker arm 26 also moves upward.

At this time, cam nose portion 34*c* of intake cam 34 is lifted up via link rod 27.

Therefore, cam surface 34*e* of intake cam 34, which is in contact with valve lifter 35 by the rotation of intake side camshaft 14, gets close to base portion 34*a* and the valve lift amount is controlled to a small lift amount shown by L1 in FIG. 4A.

Figure 5A:
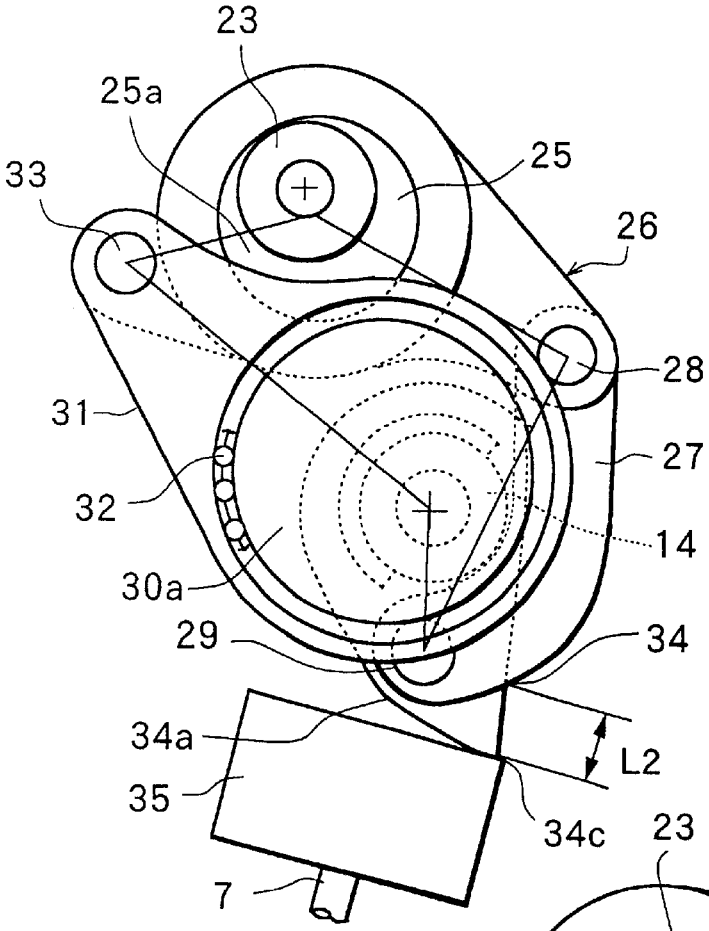
FIG. 5A is a function explanation view of the variable valve mechanism showing a valve opening state at a maximum lift amount.
Figure 5B:
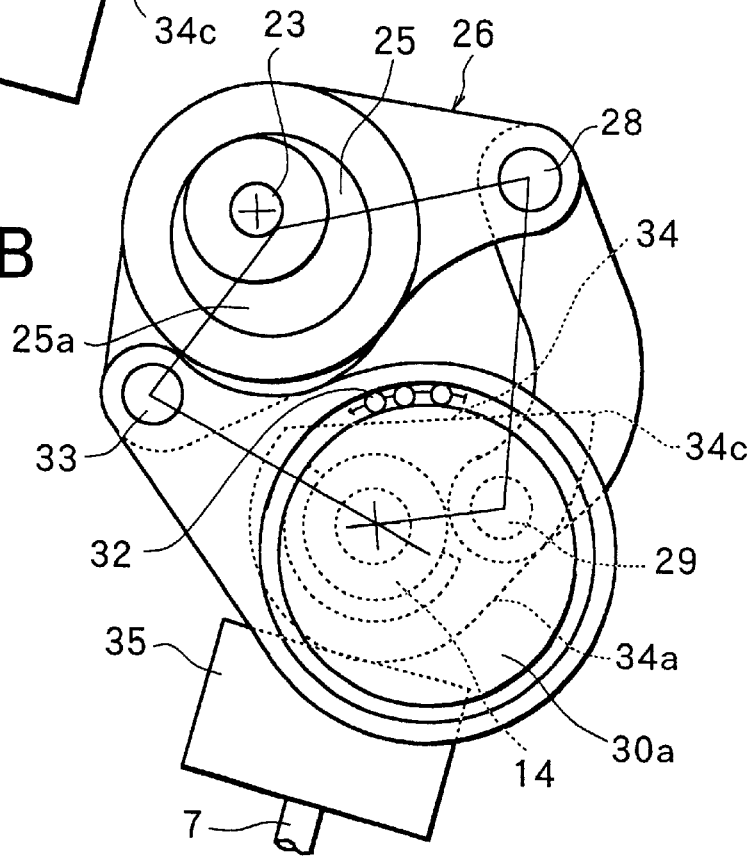
FIG. 5B is a function explanation view of the variable valve mechanism showing a valve closing state at the maximum lift amount.

On the other hand, FIG. 5A and FIG. 5B respectively show a state where the valve lift amount is controlled to a maximum amount.

When DC motor is driven to provide control shaft 23 with an anticlockwise rotation for controlling the lift amount to the maximum amount, thick portion 25*a* of control cam 25 moves downward and in synchronization with this rocker arm 26 also moves downward.

At this time, cam nose portion 34*c* of intake cam 34 is pushed down via link rod 27.

Therefore, cam surface 34*e* of intake cam 34, which is in contact with valve lifter 35 by the rotation of intake side camshaft 14, is positioned between a tip of cam nose portion 34*c* and base portion 34*a*, and the valve lift amount is controlled to a large amount shown by L2 in FIG. 5A.

Figure 6:
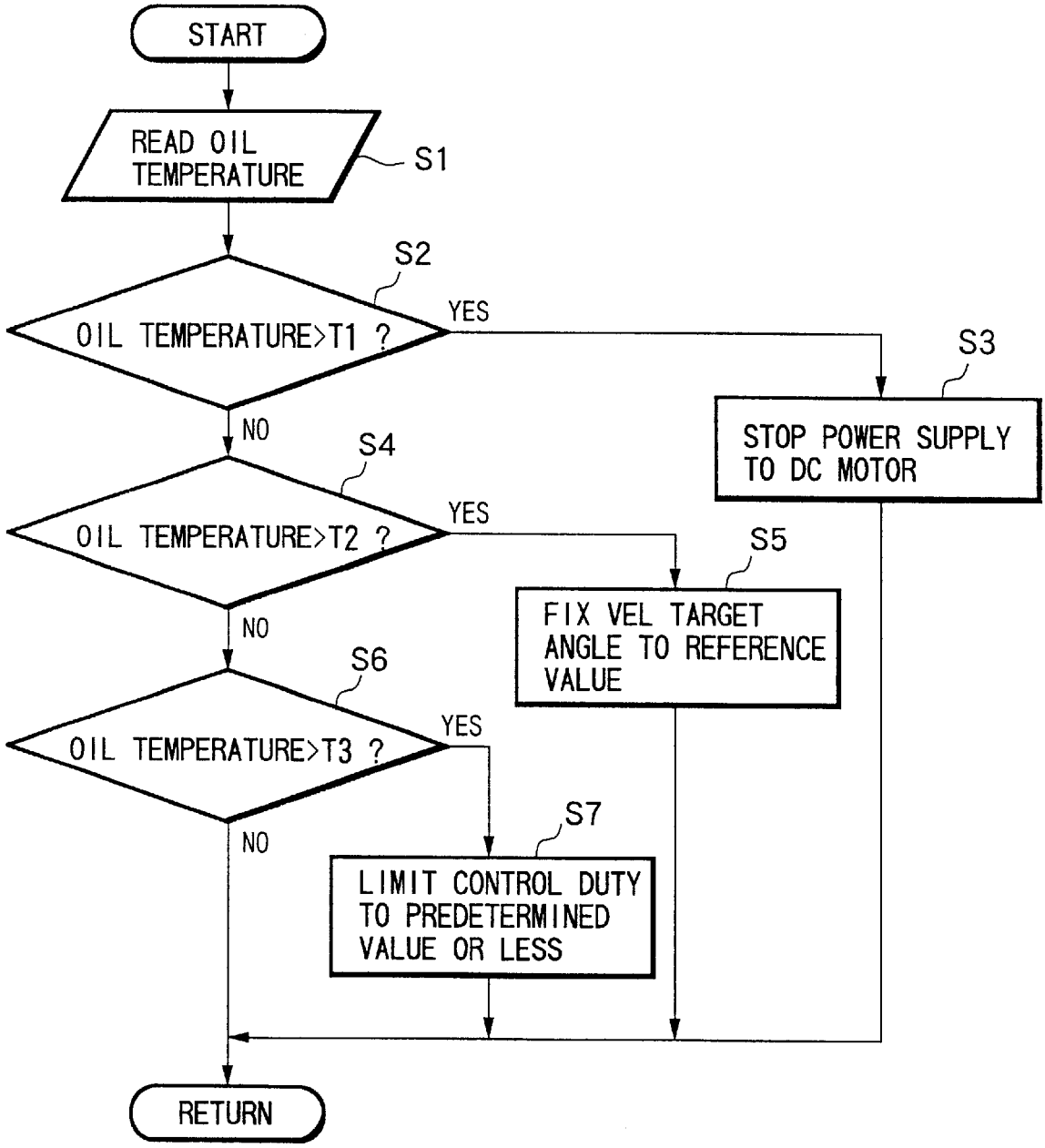
FIG. 6 is a flowchart showing a first embodiment of a feedback control of the variable valve mechanism.

Next, setting processes of various parameters in a feedback control of VEL mechanism 16 will be described in accordance with a flowchart of FIG. 6.

In step S1, an engine rubricating oil temperature (oil temperature) to be detected by an oil temperature sensor 71 is read in.

The oil temperature is a parameter representing an engine temperature, and a cooling water temperature can be read in instead of the oil temperature.

In step S2, it is judged whether or not the oil temperature read in step S1 is higher than a first threshold value T1 (for example, 130° C.) previously stored.

If the oil temperature is higher than the first threshold value T1, control proceeds to step S3 where the power supply to DC motor 36 is forcibly stopped.

If the electric current is supplied to DC motor 36 under a condition that the oil temperature is higher than the first threshold value T1, heat generated at power transistor is further added, under a high temperature environment. Thus, there is a possibility of the burn out of VEL-CU 18 and also there is a possibility of the burn out of DC motor 36 disposed integrally.

Therefore, the supply of electric current to DC motor 36 is stopped so as to prevent power transistor from generating heat.

If the supply of electric current to DC motor 36 is stopped, the valve lift amount becomes the minimum amount due to a reaction of cam. Thereby, although engine drivability is lowered, the burn out of DC motor 36 or the burn out of VEL-CU 18 can be avoided.

On the other hand, if it is judged in step S2 that the oil temperature is equal to or less than the first threshold value T1, control proceeds to step S4 where it is judged whether or not the oil temperature is higher than a second threshold value T2 (for example, 120° C.) that is lower than the first threshold value T1, in other words, whether or not T2<oil temperature≦T1.

If it is judged in step S4 that T2<oil temperature, control proceeds to step S5.

Here, since T2<oil temperature≦T1, the oil temperature is relatively low compared with the time when T1<oil temperature. However, if the electric current is supplied normally to DC motor 36, there is a possibility of the burn out of DC motor 36 or the burn out of VEL-CU 18.

Therefore, in step S5, the target angle of control shaft 23 is fixed to a reference angle previously stored.

The reference angle is previously set as a value capable of sufficiently maintaining the engine drivability even when the lift amount and operating angle of intake valve 7 are fixed so as to be equivalent to the reference angle.

If the target angle at that time is not the reference angle, the switching of target angle is executed to fix the target angle to the reference angle.

Accordingly, when the target angle is switched to the reference angle, a feedback control is performed so as to coincide the actual angle of control shaft with the target angle by supplying the electric current. However, since the target angle is not changed thereafter, it is sufficient to supply a low holding current to DC motor 36. Consequently, a driving current to DC motor 36 is suppressed with respect to a change in engine operating conditions.

Thus, the heat generation of power transistor is suppressed by the suppression of electric current, and the burn out of DC motor 36 or the burn out of VEL-CU 18 can be avoided without largely deteriorating the drivability of engine 1.

Further, it is judged in step S4 that the oil temperature is equal to or less than the threshold value T2, control proceeds to step S6.

In step S6, it is judged whether or not the oil temperature is higher than a third threshold value T3 (for example, 105° C.) which is lower than the second threshold value T2, in other words, whether or not T3<oil temperature≦T2<T1.

If it is judged in step S6 that T3<oil temperature, control proceeds to step S7.

In step S7, an upper limit value of control duty (ON duty) of power transistor included in VEL-CU 18 is changed to a value (for example, 70%) smaller than a value of normal time (for example, 100%).

If the upper limit value of ON duty is made small, an increase of ON duty by the feedback control is restricted, so that the electric current at the time of changing target angle is suppressed.

Consequently, although response characteristics to a change in target angle is lowered, intake valve 7 can be controlled to the target angle (lift amount and operating angle) corresponding to operating conditions at that time.

When it is judged in step S6 that oil temperature≦T3, the control routine is ended without proceeding to steps S3, S5 and S7, so that the control duty is computed based on the target angle corresponding to engine operating conditions and also the feedback control is performed with the upper limit value of control duty (ON duty) of power transistor being the normal value (for example, 100%).

Note, the construction may be such that, instead of providing the restriction to ON duty of power transistor, a change speed of target angle of control shaft 23 is restricted.

Specifically, for example, a simple average value between the target angle retrieved from a map based on engine operating conditions (engine load, engine rotation speed and the like) and a final target angle at previous time, is set as a present target angle.

Thus, a change in target angle used for the actual control to the target angle required from engine operating conditions is delayed. Then, if the change in target angle is delayed, a response delay of feedback control becomes relatively smaller, so that amplitude of electric current by the feedback control is suppressed and an absolute value of electric current is restricted to be low.

Further, the construction is such that when T2<oil temperature≦T1, the target angle is fixed to the reference angle. However, if the target angle at that time does not coincide with the reference angle, it is required to change the actual angle by the feedback control. Therefore, the construction may be such that, in order to suppress the electric current at the time of feedback control, simultaneously with changing the actual angle, control duty is restricted as in step S7.

As mentioned above, in the above embodiment, the construction is such that as the engine temperature becomes higher, the electric current to be supplied to DC motor 36 is suppressed to be smaller, so that the heat generation due to the supply of electric current is suppressed. Thereby, without deteriorating the engine drivability, it is possible to avoid the burn out of motor 36 or the burn out of VEL-CU 18.

Figure 7:
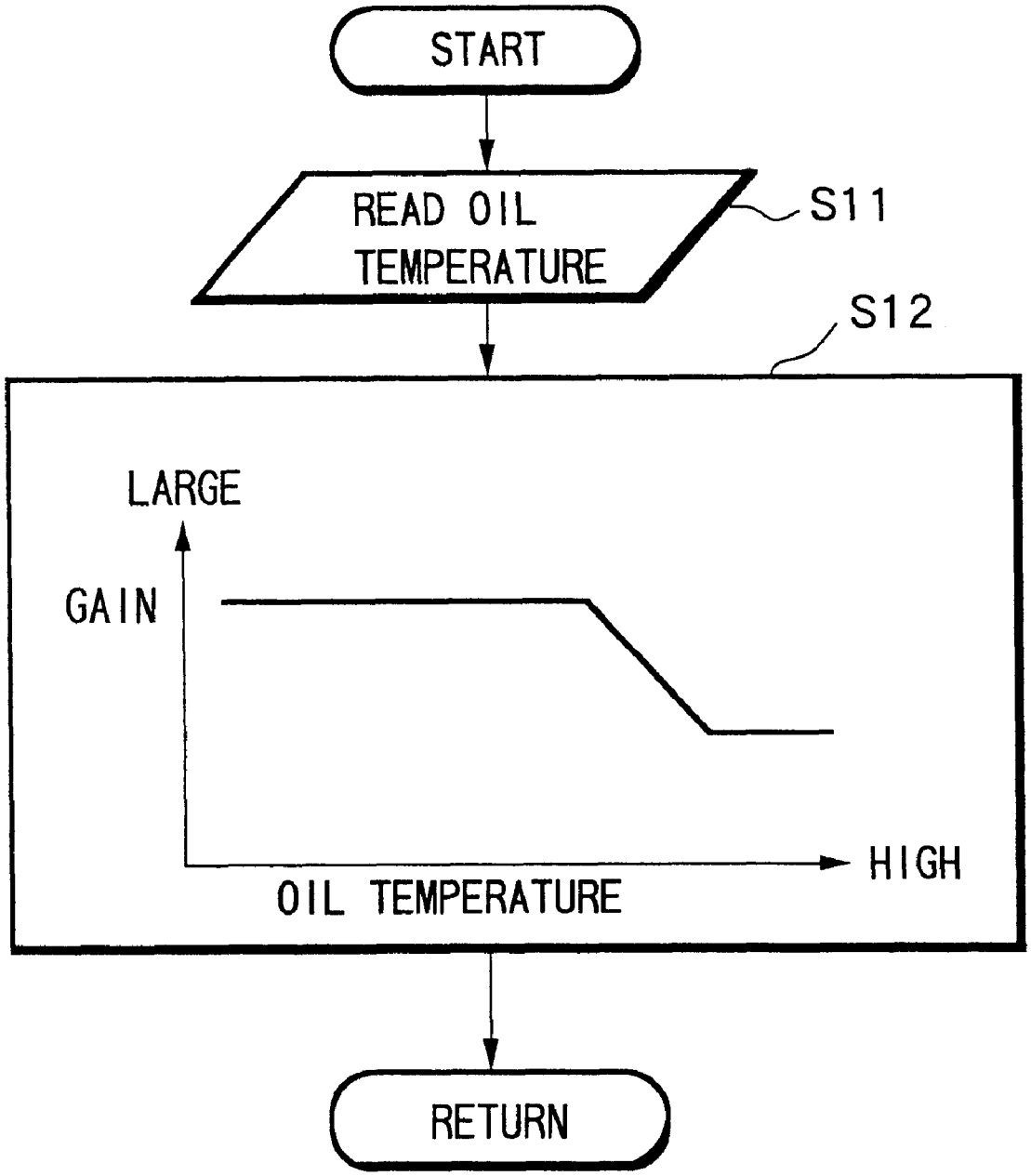
FIG. 7 is a flowchart showing a second embodiment of a feedback control of the variable valve mechanism.

A flowchart of FIG. 7 shows a second embodiment. In step S11, an engine rubricating oil temperature (or cooling water temperature) is read in.

Then, in step S12, a feedback gain in the feedback control of operating angle of control shaft is set in accordance with the oil temperature (or cooling water temperature) read in step S11.

Specifically, as shown in the figure, higher the oil temperature (or cooling water temperature), lower the feedback gain is set.

If the feedback gain equivalent to that at a low temperature is set under the high oil temperature (or cooling water temperature) environment, as a result that the electric current is controlled to be high by the feedback control, the heat generation of power transistor becomes large.

On the contrary, if the feedback gain is set to be small, a change in electric current is small relative to the same deviation. Therefore, although the response characteristics become lower, the electric current is suppressed to be low.

Namely, although the present embodiment realizes the same function and effect as in the case of delaying a change speed of target angle, by changing in stepwise the feedback gain, utmost gain setting capable of avoiding the burn out of motor 36 or the burn out of VEL-CU 18 is performed under the temperature environment at that time. Consequently, compared with the construction that the restriction of electric current is performed in different ways for every temperature conditions as in the first embodiment, the construction of the second embodiment is simplified.

The entire contents of Japanese Patent Application No. 2001-188044, filed Jun. 21, 2001, are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the foregoing description of the embodiments according to the present invention are provided for illustration only, and not for the purpose of limiting the invention as defined by the appended claims and their equivalents.

What is claimed is:

1. A method of controlling a variable valve mechanism that changes an opening characteristic of an engine valve by a rotation force of a direct current motor, comprising the steps of:

detecting operating conditions of an engine;

computing a target value of said opening characteristic based on said engine operating conditions;

detecting an opening characteristic of an engine valve;

computing a control signal of electric current to be supplied to said direct current motor so that the opening characteristic coincides with said target value;

detecting an engine temperature; and forcibly lowering the electric current to be supplied to said direct current motor when the engine temperature exceeds a predetermined temperature.

2. A method of controlling a variable valve mechanism according to claim 1, wherein said step of forcibly lowering the electric current largely lowers the electric current as the engine temperature becomes higher.

3. A method of controlling a variable valve mechanism according to claim 1, wherein said step of forcibly lowering the electric current forcibly lowers the electric current to be supplied to said direct current motor by providing restriction to said control signal.

4. A method of controlling a variable valve mechanism according to claim 1, wherein said step of forcibly lowering the electric current forcibly lowers the electric current to be supplied to said direct current motor by providing restriction to a change speed of target value of said opening characteristic.

5. A method of controlling a variable valve mechanism according to claim 1, wherein said step of forcibly lowering the electric current forcibly lowers the electric current to be supplied to said direct current motor by forcibly fixing the target value of said opening characteristic to a previously set reference value.

6. A method of controlling a variable valve mechanism according to claim 1, wherein said step of forcibly lowering the electric current forcibly lowers the electric current to be supplied to said direct current motor by lowering a gain of said feedback control.

7. A method of controlling a variable valve mechanism according to claim 1, wherein said step of forcibly lowering the electric current forcibly stops the supply of electric current to said direct current motor when the engine temperature exceeds the predetermined temperature.

8. A method of controlling a variable valve mechanism according to claim 1, wherein said variable valve mechanism is a mechanism that changes successively a valve lift and a valve event in accordance with an angle of a control shaft that is rotated by said direct current motor.

9. An apparatus for controlling a variable valve mechanism that changes an opening characteristic of an engine valve by a rotation force of a direct current motor, comprising:

temperature detecting means for detecting an engine temperature;

opening characteristic detecting means for detecting an opening characteristic of an engine valve;

operating condition detecting means for detecting operating conditions of an engine;

target value computing means for computing a target value of said opening characteristic based on the engine operating conditions detected by said operating condition detecting means;

feedback control means for feedback controlling an electric current to be supplied to said direct current motor so that the opening characteristic detected by said opening characteristic detecting means coincides with said target value; and electric current lowering means for forcibly lowering the electric current to be supplied to said direct current motor when the engine temperature detected by said temperature detecting means exceeds a predetermined temperature.

10. An apparatus for controlling a variable valve mechanism that changes an opening characteristic of an engine valve by a rotation force of a direct current motor, comprising:

a temperature detector that detects an engine temperature;

an opening characteristic detector that detects an opening characteristic of an engine valve;

an operating condition detector that detects operating conditions of an engine; and a control unit that is input with detection signals from said temperature detector, said opening characteristic detector and said operating condition detector, and computes a control signal of electric current to be supplied to said direct current motor based on said detection signals, to output said control signal, wherein said control unit computes a target value of said opening characteristic based on the engine operating conditions detected by said operating condition detector, and feedback controls said control signal so that the opening characteristic detected by said opening characteristic detector coincides with said target opening characteristic, and also forcibly lowers the electric current to be supplied to said direct current motor when the engine temperature detected by said temperature sensor exceeds a predetermined temperature.

11. An apparatus for controlling a variable valve mechanism according to claim 10, wherein said control unit largely lowers the electric current as the engine temperature becomes higher.

12. An apparatus for controlling a variable valve mechanism according to claim 10, wherein said control unit forcibly lowers the electric current to be supplied to said direct current motor by providing restriction to said control signal.

13. An apparatus for controlling a variable valve mechanism according to claim 10, wherein said control unit forcibly lowers the electric current to be supplied to said direct current motor by providing restriction to a change speed of target value of said opening characteristic.

14. An apparatus for controlling a variable valve mechanism according to claim 10, wherein said control unit forcibly lowers the electric current to be supplied to said direct current motor by forcibly fixing the target value of said opening characteristic to a previously set reference value.

15. An apparatus for controlling a variable valve mechanism according to claim 10, wherein said control unit forcibly lowers the electric current to be supplied to said direct current motor by lowering a gain of said feedback control.

16. An apparatus for controlling a variable valve mechanism according to claim 10, wherein said control unit forcibly stops the supply of electric current to said direct current motor when the engine temperature exceeds the predetermined temperature.

17. An apparatus for controlling a variable valve mechanism according to claim 10, wherein said direct current motor, said control unit and said opening characteristic detector are mounted to the engine integrally.

18. An apparatus for controlling a variable valve mechanism according to claim 10, wherein said variable valve mechanism is a mechanism that changes successively a valve lift and a valve event in accordance with an angle of a control shaft that is rotated by said direct current motor.

* * * * *